United States Patent [19]

Lalli

[11] Patent Number: 5,047,964

[45] Date of Patent: Sep. 10, 1991

[54] MATERIAL DEFORMATION PROCESSES

[75] Inventor: Lawrence A. Lalli, Franklin Township, Pa.

[73] Assignee: Aluminum Company of America, Pittsburgh, Pa.

[21] Appl. No.: 519,032

[22] Filed: May 4, 1990

Related U.S. Application Data

[63] Continuation-in-part of Ser. No. 683,005, Dec. 18, 1984, abandoned.

[51] Int. Cl.[5] ..... B21B 37/00

[52] U.S. Cl. ..... 364/557; 72/11; 72/13; 364/472

[58] Field of Search ..... 364/557, 476, 472; 72/10, 11, 13, 16, 199, 200

[56] References Cited

U.S. PATENT DOCUMENTS

| | | | |
|---|---|---|---|
| 3,927,545 | 12/1975 | Morooka | 72/13 |
| 4,274,273 | 6/1981 | Fapiano et al. | 72/13 |
| 4,373,364 | 2/1983 | Tanimoto et al. | 72/8 |
| 4,465,382 | 8/1984 | Iuchi et al. | 374/9 |
| 4,494,205 | 1/1985 | Dairiki et al. | 364/472 |
| 4,569,023 | 2/1986 | Wakamiya | 364/472 |

OTHER PUBLICATIONS

Bruzga, "A Review of the Benson-Flook-Diehr Trilogy: Can the 'Subject Matter' Validity of Patent Claims Reciting Mathematical Formulae be determined under 35USC section 112?," 1987, JPTOS; pp. 197-216.

*Primary Examiner*—Thomas G. Black
*Attorney, Agent, or Firm*—Daniel A. Sullivan, Jr.

[57] ABSTRACT

A method for measuring temperature in a rolling operation, including measuring mechanical parameters of the rolling operation and calculating friction and temperature from the mechanical parameters.

27 Claims, 1 Drawing Sheet

MATERIAL DEFORMATION PROCESSES

CROSS-REFERENCE TO RELATED APPLICATION

This application is a continuation-in-part application of U.S. Ser. No. 683,005, filed Dec. 18, 1984 now abandoned.

SUMMARY OF THE INVENTION

It is an object of the invention to provide a new method for determining friction and material temperature in a rolling operation process where material is run between rolls for decreasing thickness of the material by plastic deformation.

It is a further object of the invention to provide for the determination of temperature in a rolling operation on the basis of mechanical parameters of the rolling operation. It is important to note that it is temperature which is determined in the present invention, not temperature change. Thus, it is not necessary in the present invention to proceed to a knowledge of temperature by way of determination of a temperature change which must first be added to, or subtracted from, a previously known temperature before the current temperature may be known. Temperature determined according to the invention may be expressed on the basis of any of the known temperature scales, ° Kelvin, ° Celsius, ° Fahrenheit, etc.

It is another object of the invention to provide for the determination of temperature in other forming processes involving plastic deformation, such as extrusion processes.

These as well as other objects which will become apparent from the discussion that follows are achieved, according to the present invention, by measuring mechanical parameters of the rolling operation and calculating friction and temperature from the mechanical parameters.

DESCRIPTION OF THE PREFERRED EMBODIMENTS

Figure 1:
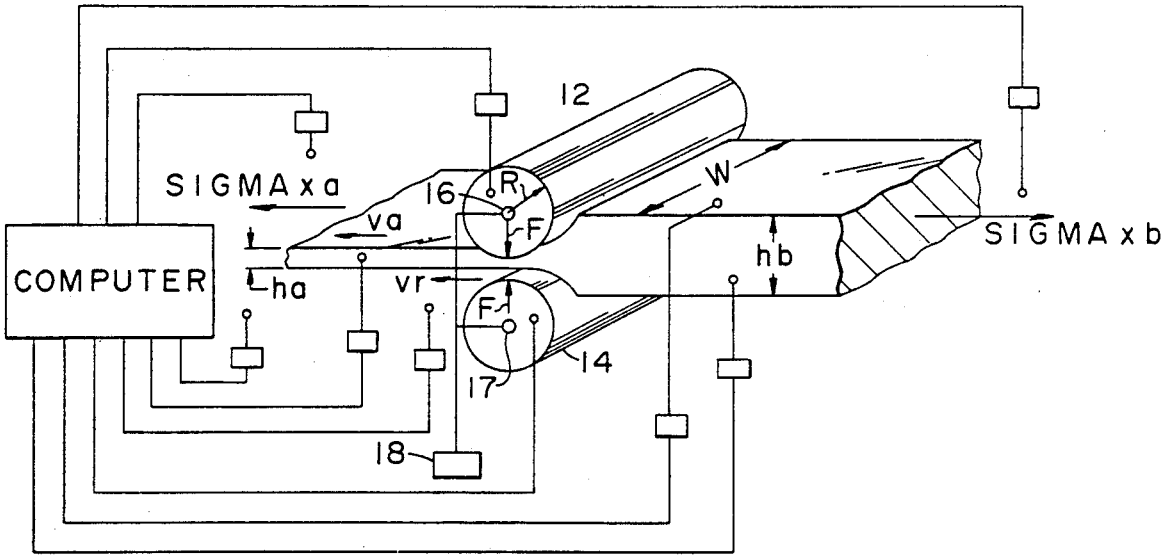
FIG. 1 is a schematic view of a rolling operation.

With reference to FIG. 1, a metal, e.g. aluminum, rolling operation includes metal sheet 10 of width W and entry thickness hb passing between two steel rolls 12 and 14 of radius R and emerging with exit thickness ha. The rolls act on the sheet with force F. The sheet on the entry side is under tension SIGMAxb, which is a tensile stress having units of force per unit area. Tension on the exit side is SIGMAxa. A further parameter of the rolling operation is "slip" f, also referred to as "fraction extrusion". Slip f is calculated using the formula $$f=(va-vr)/vr$$

where va and vr appear in FIG. 1, va being the exit sheet speed and vr the tangential roll velocity.

According to a preferred embodiment of the invention, the above mechanical parameters of a rolling operation, namely gage into and out of rolling stand, hb and ha, width W of material, tensions on both sides of the rolling stand, SIGMAxb and SIGMAxa, roll radius R, roll force F, and slip f, are measured and, from them, temperature is calculated. Data gathering may be done using appropriate sensors. Signals from the sensors may be fed to a digital computer through signal converters, and the calculation of temperature performed in the computer.

FIG. 1 shows the computer by a large box and the sensors and converters by coupled "°"'s and small boxes, respectively.

The calculated temperature is an inferred average temperature for the region undergoing the plastic deformation caused by the rolling. This inferred average temperature is the same temperature which, when input into equation (1-2) below, would result in the values of force, torque, and slip. This is the typical forward procedure for predicting force, torque, and slip based on an input temperature. Thus, the inferred average temperature results from evaluating the solution to the roll bite equations for force, or torque, and slip in an inverse procedure.

The calculation uses three basic equations (whose terms are defined below) as follows:

$$m=2.*r/SQRT(1.0+4.*r*r*c*c) \quad (10c)$$

$$SIGMAf=SIGMA0*SQRT(3.)/(2.*SQRT(1.-*m*c*c)) \quad (9)$$

$$TEMP^{\circ}K.=Q/(K*ALOG(A*TRM**n/EPSILONDOT)) \quad (1\text{-}2)$$

The numbers given the equations correspond to the equation numbers in the paper entitled "An Analytical Rolling Model Including Through Thickness Shear Stress Distributions" by the inventor, Lawrence A. Lalli, *Journal of Engineering Materials and Technology*, January, 1984, Volume 106, pages 1-8. This paper, which is incorporated here by reference, may be referred to for information on derivation of the above three equations and other equations used herein. Greek letters have been transliterated. Otherwise, the symbols used herein are consistent with those used in the paper. "1-2" refers to the equation for SIGMAf occurring in the paper between equations (1) and (2); the equation here is an inversion of that equation for temperature.

In the first equation (10c), a coefficient of friction m for the conditions in the roll bite between roll face and material being rolled is calculated on the basis of r (the surface shear stress divided by the difference between the horizontal and vertical stresses) and c (the mean shear stress divided by the surface shear stress). c is about 0.6 for the rolling of aluminum. c is determined by comparison with Orowan's theory of rolling and is validated empirically, using techniques as explained in the above-incorporated paper. "*" means "multiplied by"; "/" means "divided by"; SQRT is a function which returns the square root of the quantity in parentheses. This use of the word "return" is as it is used in the field of computer programming. What it means from a practical point of view is that the computer replaces, for instance, "SQRT(4)" with "2".

In the second equation, the "m" calculated in the first equation is used to calculate flow stress SIGMAf. SIGMA0 is the difference between the horizontal and vertical stresses.

The third equation yields temperature, TEMP° K., in degrees Kelvin. Flow stress from the second equation enters in the term "TRM", where TRM=(EXP(ALPHA*SIGMAf)−EXP(−ALPHA*SIGMAf))/2 "Q" is the activation energy for deformation, and "K" the universal gas constant. The function ALOG returns the natural logarithm. "A" is a constant. Double asterisk, **, signifies "raised to the power of", in this case the power of "n". EPSILONDOT is the mean strain rate. In "TRM", "EXP" is a function returning "e" raised to the power of the quantity in parentheses. ALPHA is a constant. For 3004 aluminum alloy, $$ALPHA = 0.0323\ (1/MPa)$$

$$Q = 192910\ J/mol$$

$$A = 2.01 \times 10^{12}\ (1/s)$$

$$n = 3.68$$

These constants can be determined for other alloys by hot torsion testing. See, for example, "Determination of Flow Stress" by T. Sheppard and D. S. Wright, *Metals Technology*, June, 1979, beginning on page 219 ("Q" here="DELTA-H" there). The hot torsion method is readily modifiable for hot axi-symmetric testing, as well.

A particularly advantageous aspect of the above three basic equations is that they are analytic, i.e., they permit direct calculation of friction m, flow stress SIGMAf, and temperature TEMP° K., rather than requiring indirect calculation by iterative techniques. An important result is that computer calculations are very fast, making automatic control of temperature feasible. The calculated temperature can be compared to a setpoint, an error determined, and mechanical parameters, such as roll force F, tension SIGMAxa, rolling speed, etc., adjusted to minimize the error. Controlled temperature means controlled sheet microstructure and improved sheet properties. Uniform properties are achieved over the length of the sheet.

Whether used for closed loop control of temperature or not, determination of temperature according to the invention may be utilized to assist in selecting parameters of a rolling process. Rolling mill process parameters are thus influenced as a function of material temperature. For instance, since the rolls contact the material, roll temperature is a function of material temperature. So knowledge of material temperature may be used in determining roll temperature. And, since the rolls expand and contract as a function of temperature, knowledge of roll temperature can be used to assist in determining the physical constraints to be placed on the rolls for obtaining desired material thickness. In a basic example, the bearings 16,17 of opposing rolls are moved toward or away from one another by a movement means 18 an amount counteracting roll diameter change caused by roll temperature change, in order to keep material thickness constant.

A computer program for transforming the measured mechanical parameters is as follows. Assignment of constants may be as explained above and is not included. Equation numbers from the above-referenced paper have been placed where appropriate.

```
P=F/W

DELTA=hb-ha

HCN=16.*(1.-NU**2)/pi*E

R'=R*(1.0+HCN*P/DELTA)                                  (34)

TERM=ATAN(SQRT(DELTA/ha))

f=(va-vr)/vr                                            (27)

TERM1=0.5*TERM-ATAN(SQRT(f))

xb=SQRT(DELTA*R')                                       (21)

TERM2=2.*SQRT(ha*R')*TERM-xb

TERM3=P+SIGMAxb*xb

TERM4=TERM3*4.*SQRT(R'/ha)*TERM1

TERM5=(SIGMAxb-SIGMAxa)*R'*ALOG(hb-
  /ha/(1.+f)**2)

TERM6=TERM3*ALOG(hb/ha)+(SIGMAx-
  b-SIGMAxa)*TERM2

r=TERM6/(TERM4-TERM5)                                   (35)

m=2.*r/SQRT(1.0+4.*r*r*c*c)                             (10c)

SIGMA0=TERM3/(TERM2+r*R'*ALOG(hb-
  /ha/(1.+f)**2))                                       (32)

SIGMAf=SIG-
  MA0*SQRT(3.)/(2.*SQRT(1.-m*m*c*c))                    (9)

TRM=(EXP(ALPHA*SIGMAf)-EXP(-ALPHA*-
  SIGMAf))/2.

EPSILONDOT=va*ALOG(hb/ha)/SQRT(R'*(hb-
  -ha))

TEMP°
  K.=Q/(K*ALOG(A*TRM**n/EPSILONDOT))                    (1-2)
```

"HCN" is Hitchcock's constant, "E" the modulus of elasticity of steel (steel rolls), and NU is Poisson's ratio for steel.

"ATAN" is a function returning in radians the arc whose tangent is the quantity in the parentheses following it.

In other embodiments of the invention, the concepts explained above may be varied to infer temperature as follows:

(1) If the through thickness shear stress distribution is ignored, c may be set equal to zero, and the equations can still be used.

(2) If the elastic deformation of the rolls is ignored, Hitchcock's constant, HCN, may be set equal to zero.

(3) If the entry sheet speed is measured, $v_b$, instead of $v_a$, then slip may be calculated as $$f = (v_b h_b / h_a - v_r)/v_r$$

(4) If another relationship is used to express flow stress as a function of strain rate and temperature, then the procedure in this patent can still be used to calculate the flow stress, SIGMAf, and friction, m. In this case, a separate and different equation would be inverted to then determine temperature.

(5) An example of (4) above would be the condition for "high stresses" when the variable, D, in my above-referenced paper between Equations 1 and 2 is very large. For $(D/A)^{2/n}$ much greater than 1, the equation for SIGMAf reduces to $$\text{SIGMAf} = (1/\text{ALPHA})*(\text{ALOG}((D/A)^{1/n} + [(DA)^{2/n}]^{1/2}))$$

$$= (1/\text{ALPHA})*(\text{ALOG}(2.*(D/A)^{1/n}))$$

*Then* $EXP(ALPHA*SIGMAf)=2.*(D/A)^{1/n}$ $D/A=[(\frac{1}{2})*EXP(ALPHA*SIGMAf)]^n$ $D/A=(\frac{1}{2})^n*EXP(ALPHA*n*SIGMAf)$ $EPSILONDOT*EXP(Q/(K*T))=A*(\frac{1}{2})^n EXP(ALPHA*n*SIGMAf)$ $Q/(K*T)=ALOG((A/EPSILONDOT)*(\frac{1}{2})^n EXP(ALPHA*n*SIGMAf))$ $T=Q/(K*ALOG((A/EPSILONDOT)*(\frac{1}{2})^n EXP(ALPHA*n*SIGMAf)))$ $T=Q/(K*(ALOG(A/EPSILONDOT)*(\frac{1}{2})^n)+ALPHA*n*SIGMAf))$ The same equation for temperature is derivable by letting the second term in the above expression for TRM go to zero when the stress is high (SIGMAf approaches infinity); then $TRM=EXP(ALPHA*SIGMAf)/2$ (6) If slip is not measured, it may be assumed to have a value such as zero and Equation 32 in the paper may then be solved for SIGMA0 using only the force measurement. Then SIGMAf and T could be solved for as before.

(7) Using Equation 33,

```
                    G/W = 2*R*TAUS*(xb - 2.*xc)
Equation 29:        f = (xc**2)/(R'*ha)
                              or
                    xc = SQRT(f*R'*ha)
Substituting into Equation 33,
    G/W = 2.*R*SIGMA0*r*(xb - 2.*SQRT(f*R'*ha))
Since r = TAUS/SIGMA0, G/W = 2.*R*SIGMA0*r(xb -
2.*SQRT(f*R'*ha))
Solving for SIGMA0,
  (#1)  SIGMA0 = G/(2*W*R*r*(xb - 2.*SQRT(f*R'*ha)))
Solve Equation 30 for SIGMA0,
  ATAN(SQRT(f)) = (1/2)*ATAN (SQRT(DELTA/ha)) -
  ((SIGMAxb - SIGMAxa)/SIGMA0 + ALOG(hb/ha))/(4.*r*SQRT(R'/ha))
Therefore,
4.*r*SQRT(R'/ha)*((1/2)*ATAN(SQRT(DELTA/ha)) - ATAN(SQRT(f))) =
    (SIGMAxb - SIGMAxa)/(SIGMA0) + ALOG(hb/ha)
Therefore,
  (#2)  SIGMA0 = (SIGMAxb - SIGMAxa)/((4.*r*SQRT(R'/ha))*
  ((1/2)*ATAN(SQRT(DELTA/ha)) - ATAN(SQRT(f))) - ALOG(hb/ha))
Equate the above 2 expressions for SIGMA0,
    (1/r)*G/(2.*W*R*(xb - 2.*SQRT(f*R'*ha))) =
    (SIGMAxb - SIGMAxa)/(r*BETA - ALOG(hb/ha))
Where,
BETA = 4.*SQRT(R'/ha)*((1/2)*ATAN(SQRT(DELTA/ha)) -
ATAN(SQRT(f)))
And,
    (1/r)*GAMMA = (SIGMAxb - SIGMAxa)/(r*BETA - ALOG(hb/ha))
Where,
    GAMMA = G/(2.*W*R(xb - 2.*SQRT(f*R'*ha)))
    (1/r)*(r*BETA - ALOG(hb/ha)) = (sigmaxb - SIGMAxa)/GAMMA
    BETA - (1/r)*ALOG(hb/ha) = (SIGMAxb - SIGMAxa)/GAMMA
    BETA - (SIGMAxb - SIGMAxa)/GAMMA = (1/r)*ALOG(hb/ha)
    r = ALOG(hb/ha)/(BETA - (SIGMAxb - SIGMAxa)/GAMMA)
```

This new equation for r can replace the existing one (Equation 35). It uses torque and slip instead of force and slip to calculate r.

Now that r is known, SIGMA0 may be calculated from either (#1) or (#2) above, and calculations for SIGMAf and m may proceed as before.

While the invention has been described in terms of preferred embodiments, the claims appended hereto are intended to encompass all embodiments which fall within the spirit of the invention.

What is claimed is:

1. A rolling process comprising the steps of passing material between rolls for decreasing thickness of the material by plastic deformation and determining friction and material temperature by measuring mechanical parameters of the step of passing and calculating friction and temperature from the mechanical parameters, the calculated temperature being a temperature for the region undergoing plastic deformation, the calculated friction being friction between roll face and material.

2. A process as claimed in claim 1, the calculation being on the basis of analytic formulas.

3. A process as claimed in claim 1, said parameters being gage into and out of rolling stand, hb and ha, width W of material, tensions on both sides of the rolling stand, SIGMAxb and SIGMAxa, roll radius R, roll force F, and slip f.

4. A process as claimed in claim 3, the calculation being on the basis of analytic formulas.

5. A process as claimed in claim 1, the calculation being on the basis of the following formulas:

$m=2.*r/SQRT(1.0+4.*r*r*c*c)$ $SIGMAf=SIGMA0*SQRT(3.)/(2.*SQRT(1.-m*m*c*c))$

*TEMP*

$K.=Q/(K*ALOG(A*TRM**n/EPSILONDOT))$

*where*

$TRM=EXP(ALPHA*SIGMAf)-EXP(-ALPHA*SIGMAf)/2.$

6. A rolling apparatus comprising roll means for passing material between rolls for decreasing thickness of the material by plastic deformation, means for measuring mechanical parameters of the passing of material between the rolls, and means for calculating friction between roll face and material from the mechanical parameters.

7. A rolling apparatus comprising roll means for passing material between rolls for decreasing thickness of the material by plastic deformation, means for measuring mechanical parameters of the passing of material between the rolls, and means for calculating friction and flow stress from the mechanical parameters, the calculated friction being friction between roll face and material.

8. A rolling process comprising the steps of passing material between rolls for decreasing thickness of the material by plastic deformation and determining material temperature by measuring mechanical parameters of the step of passing and calculating temperature from the mechanical parameters, the calculated temperature being a temperature for the region undergoing plastic deformation.

9. A rolling process as claimed in claim 8, further comprising influencing at least one parameter of the step of passing as a function of material temperature from the step of determining.

10. A forming process comprising the steps of plastically deforming material and determining material temperature by measuring mechanical parameters of the step of deforming and calculating temperature from the mechanical parameters, the calculated temperature being a temperature for the region undergoing plastic deformation.

11. A rolling process comprising the steps of passing material between rolls for decreasing thickness of the material by plastic deformation, determining material temperature by measuring mechanical parameters of the step of passing and calculating temperature from the mechanical parameters, the calculated temperature being a temperature for the region undergoing plastic deformation, and influencing at least one parameter of the step of passing as a function of material temperature from the step of determining.

12. A rolling process as claimed in claim 11, said parameters being selected from the list consisting of gage into and out of rolling stand, hb and ha, width W of material, tensions on both sides of the rolling stand, SIGMAxb and SIGMAxa, roll radius R, roll force F, and slip f.

13. A rolling process as claimed in claim 11, the step of influencing comprising comparing calculated temperature to a setpoint, determining an error based on the difference between calculated temperature and setpoint, and adjusting at least one parameter of the step of passing for minimizing the error.

14. A rolling process as claimed in claim 11, said material comprising sheet material.

15. A rolling process as claimed in claim 14, said sheet material comprising metal.

16. A rolling process as claimed in claim 15, said metal comprising aluminum.

17. A rolling process as claimed in claim 11, the calculated temperature representing an average temperature for the region undergoing plastic deformation.

18. A rolling process as claimed in claim 11, the calculation being on the basis of analytic formulas.

19. A rolling process as claimed in claim 11, the calculation being on the basis of the following formulas:

```
m=2.*r/SQRT(1.0+4.*r*r*c*c)

SIGMAf=SIG-
  MA0*SQRT(3.)/(2.*SQRT(1.-m*m*c*c))

TEMP
  K.=Q/(K*ALOG(A*TRM**n/EPSILONDOT))

where
  TRM=EXP(ALPHA*SIGMAf)-EXP(-AL-
  PHA*SIGMAf)/2.
```

20. An improved method of rolling wherein the rolling is monitored and corrected to minimize deviations from desired characteristics, comprising the steps of:

introducing material to an entry side of rolls in a rolling operation, passing the material between the rolls, applying sufficient pressure against the material by the rolls, and tension on the material, to plastically deform the material, measuring mechanical parameters of the operation, selected from the group consisting of gage into and out of rolling stand, hb and ha, width W of material, tensions on both sides of the rolling stand, SIGMAxb and SIGMAxa, roll radius R, roll force F, and slip f, calculating the temperature of the material between the rolls based on the measured mechanical parameters, on the basis of the following formulas:

```
m=2.*r/SQRT(1.0+4.*r*r*c*c)

SIGMAf=SIG-
  MA0*SQRT(3.)/(2.*SQRT(1.-m*m*c*c))

TEMP
  K.=Q/(K*ALOG(A*TRM**n/EPSILONDOT))

where
  TRM=EXP(ALPHA*SIGMAf)-EXP(-AL-
  PHA*SIGMAf)/2
```

comparing the calculated temperature to a setpoint temperature, and adjusting the rolling to change at least one of the mechanical parameters, as necessary, to assure that the calculated temperature substantially equals the setpoint temperature.

21. A rolling process comprising the steps of passing material between rolls for decreasing thickness of the material by plastic deformation and determining friction by measuring mechanical parameters of the step of passing and calculating friction from the mechanical parameters, the calculated friction being friction between roll face and material.

22. A rolling process comprising the steps of passing material between rolls for decreasing thickness of the material by plastic deformation and determining friction and flow stress by measuring mechanical parameters of the step of passing and calculating friction and flow stress from the mechanical parameters, the calculated friction being friction between roll face and material.

23. A rolling apparatus comprising roll means for passing material between rolls for decreasing thickness of the material by plastic deformation, means for measuring mechanical parameters of the passing of material between the rolls, and means for calculating friction and temperature from the mechanical parameters, the calculated temperature being a temperature for the region undergoing plastic deformation, the calculated friction being friction between roll face and material.

24. An apparatus as claimed in claim 23, the calculation being on the basis of analytic formulas.

25. An apparatus as claimed in claim 23, said parameters being gage into and out of rolling stand, hb and ha, width W of material, tensions on both sides of the rolling stand, SIGMAxb and SIGMAxa, roll radius R, roll force F, and slip f.

26. An apparatus as claimed in claim 25, the calculation being on the basis of analytic formulas.

27. An apparatus as claimed in claim 23, the calculation being on the basis of the following formulas:

```
m=2.*r/SQRT(1.0+4.*r*r*c*c)

SIGMAF=SIG-
  MA0*SQRT(3.)/(2.*SQRT)1.-m*m*c*c*))

TEMP"
  K.=Q/(K*ALOG(A*TRM**n/EPSILONDOT))

where
  TRM=EXP(ALPHA*SIGMAF)-EXP(-AL-
  PHA*SIGMAf)/2.
```

* * * * *

UNITED STATES PATENT AND TRADEMARK OFFICE

CERTIFICATE OF CORRECTION

PATENT NO. : 5,047,964

DATED : September 10, 1991

INVENTOR(S) : Lawrence A. Lalli

It is certified that error appears in the above-identified patent and that said Letters Patent is hereby corrected as shown below:

| | |
|---|---|
| Col. 2, line 24 | Change "(1.-*m*c*c))" to --(1.-m*m*c*c))--. |
| Col. 2, line 26 | There should not be a period after the first K. |
| Col. 5, line 60 | Change "(sigmaxb" to --(SIGMAxb--. |
| Col. 8, line 9 | There should not be a period after the first K. |
| Col. 8, line 38 | There should not be a period after the first K. |
| Col. 10, line 7 | Change "(2.*SQRT)1.-m*m*c*c*))" to --(2.*SQRT(1.-m*m*c*c*))--. |
| Col. 10, line 9 | There should not be a period after the first K. |

Signed and Sealed this

Twelfth Day of January, 1993

*Attest:*

DOUGLAS B. COMER

*Attesting Officer*

*Acting Commissioner of Patents and Trademarks*